United States Patent [19]

Smrt

[11] 4,087,048

[45] May 2, 1978

[54] SPRAYING APPARATUS

[76] Inventor: Thomas J. Smrt, 31W 300 W. Bartlett Rd., Bartlett, Ill. 60103

[21] Appl. No.: 773,199

[22] Filed: Mar. 1, 1977

[51] Int. Cl.[2] ..... B65D 83/14

[52] U.S. Cl. ..... 239/146; 222/136; 222/402.18; 239/308; 239/311; 239/373

[58] Field of Search ..... 239/146, 148, 150, 176, 239/307, 308, 311, 373, 339, 345, 346, 372, 562, 601, 364, 366, 368, 286, 654; 222/135, 136, 325, 335, 373, 399, 402.1, 402.18

[56] References Cited

U.S. PATENT DOCUMENTS

| | | | |
|---|---|---|---|
| 1,636,331 | 7/1927 | Smith | 239/654 X |
| 2,522,743 | 9/1950 | Brousseau et al. | 239/364 X |
| 3,228,667 | 1/1966 | Jones, Jr. et al. | 239/373 X |
| 3,700,144 | 10/1972 | Smrt | 239/286 X |
| 3,817,429 | 6/1974 | Smrt | 239/562 X |
| 3,924,784 | 12/1975 | Smrt | 239/601 X |

FOREIGN PATENT DOCUMENTS

| | | | |
|---|---|---|---|
| 1,516,163 | 1/1968 | France | 239/345 |

*Primary Examiner*—Evon C. Blunk
*Assistant Examiner*—Andres Kashnikow

[57] ABSTRACT

A spraying apparatus utilizes pressurized gas to spray liquid contained in a large replaceable or refillable cartridge. The cartridge is positioned within a casing which provides a pressure chamber, and a source of pressurized gas is attached to the casing to pressurize the chamber. The top of the cartridge communicates with the chamber so that the liquid is also pressurized. A tube extends from above the level of the liquid in the cartridge to the bottom of the cartridge and is attached to a valve. An opening is provided in the tube adjacent to the bottom of the cartridge, and the diameter of the tube is reduced above the opening to restrict the flow of gas through the tube and to create a pressure differential in the tube. When the valve is open, pressurized gas flows through the tube, and, since the pressure of the gas inside the tube at the opening is less than the pressure of the liquid, liquid flows through the opening, mixes with the gas within the tube, and flows through the valve.

14 Claims, 5 Drawing Figures

SPRAYING APPARATUS

BACKGROUND AND SUMMARY

This invention relates to a spraying apparatus, and, more particularly, to a spraying apparatus which has a large capacity reservoir and which uses pressurized gas to spray the contents of the reservoir.

It is a common practice to spray materials such as paint and the like with aerosol propellants. An aerosol propellant is stored in a can with the material which is to be sprayed, and the propellant forces the material through a spraying orifice when a valve is opened to atomize and spray the material. Use of aerosol propellants has several drawbacks, however. Aerosol propellants are relatively expensive, and the volume of the container is generally relatively small, usually of a size that can be conveniently held in the hand. Once the can is emptied, it is usually discarded. This not only creates a possible hazard because of any propellant which remains in the can but increases the total cost of the spraying unit.

Spray guns for spraying paint are also available. Spray guns may be operated by pressurized gas rather than aerosol propellants and may have a larger capacity for spraying a larger volume of liquid than an aerosol can. However, spray guns ordinarily require considerable clean-up time when the spraying job is completed or when a different material, e.g., a different color paint, is to be sprayed. One advantage of aerosol spray cans over spray guns is that clean-up of reservoirs, hoses, nozzles, and the like is not required.

The invention provides a large-capacity spraying apparatus which is operated by compressed gas. Material which is to be sprayed is contained in a cartridge which is removably positioned in a pressure chamber, and an aerosol-type valve and spraying nozzle are mounted on the cartridge. When the job is completed or a different material is to be sprayed, the cartridge is merely removed from the pressure chamber and replaced with another cartridge. The material is sprayed by compressed gas, e.g., air, and expensive aerosol propellants are not needed. Further, the pressure of the gas within the apparatus may be relatively low, e.g., less than 100 psi to reduce the potential hazard of using a pressurized vessel. When the spraying apparatus is not being used, neither the pressure chamber nor the cartridge is pressurized. Partially used cartridges may be sealed and stored for future use, and an empty cartridge may be refilled rather than being discarded.

DESCRIPTION OF THE DRAWING

The invention will be explained in conjunction with an illustrated embodiment shown in the accompanying drawing, in which.

DESCRIPTION OF SPECIFIC EMBODIMENT

Figure 1:
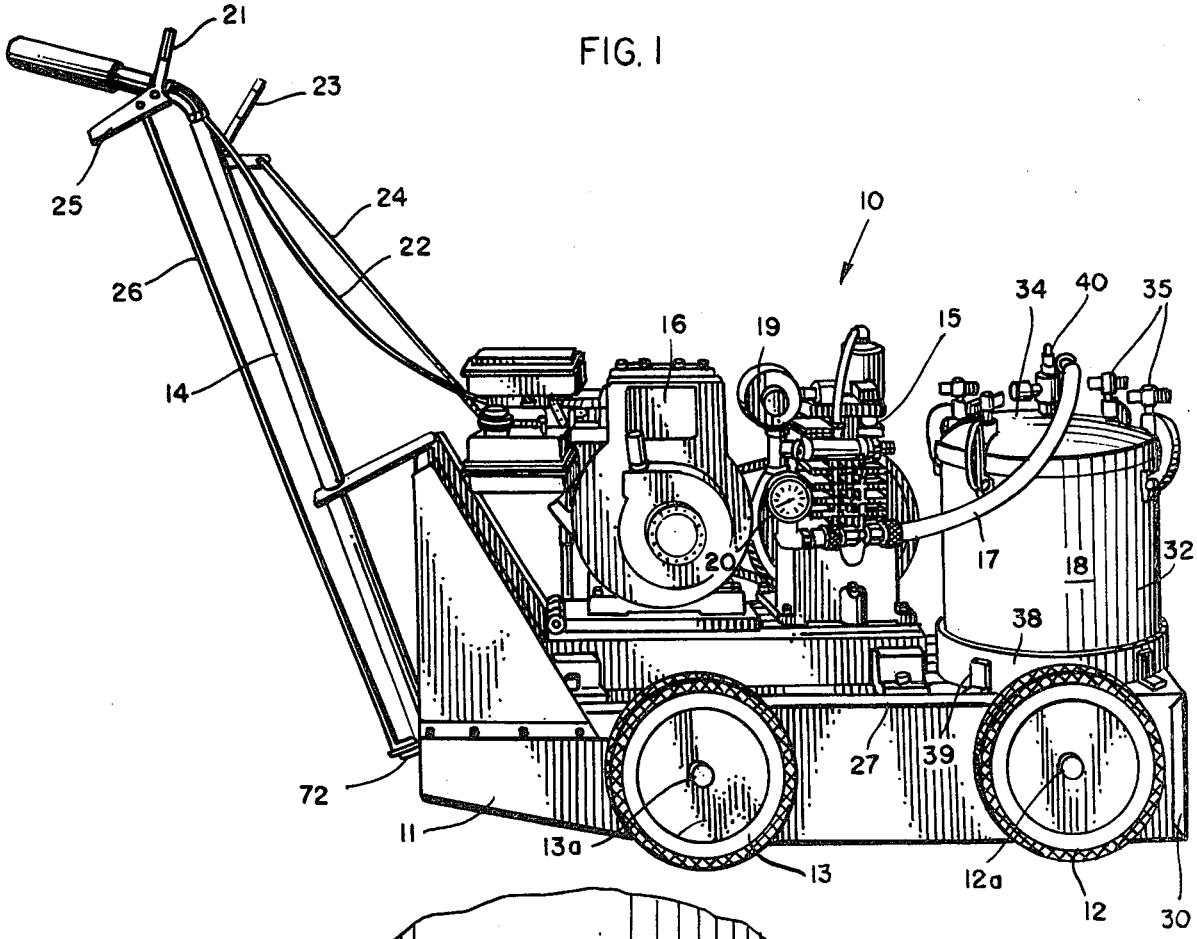
FIG. 1 is a perspective view of a spraying apparatus embodying the invention.
Figure 2:
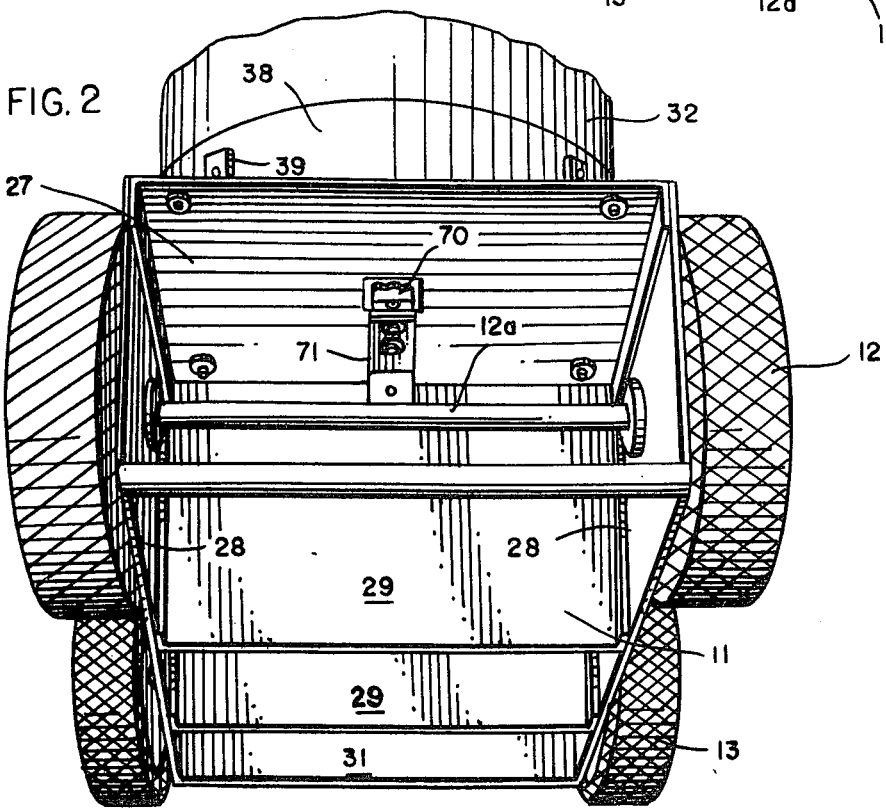
FIG. 2 is a fragmentary perspective view of the bottom front portion of the spraying apparatus.

Referring first to FIGS. 1 and 2, the invention will be explained in conjunction with a spraying apparatus 10, which is adapted to be rolled over a surface to be sprayed. Such a spraying apparatus is useful for spraying marking material, e.g., paint or dye, on a surface such as pavement, grass, or the like to mark parking areas, boundaries, etc. It will be understood, however, that the invention can also be used in a spraying apparatus other than the wheel-equipped type and can be used to spray material other than paint.

The spraying apparatus 10 includes a frame or chassis 11 which is supported by a pair of front wheels 12 and a pair of rear wheels 13. A handle 14 is attached to the frame for pushing the apparatus over the surface which is to be sprayed. An air compressor 15 is driven by an internal combustion engine 16 for supplying pressurized air through a hose 17 to a pressure vessel 18. An accumulator 19 communicates with the outlet of the compressor, and a pressure regulator 20 regulates the flow of air to the pressure vessel.

Various controls for the spraying apparatus are mounted on the end of the handle in convenient reach of the operator. A throttle lever 21 is pivotally mounted on the handle and is connected to the carburetor of the engine by a sheathed cable 22 for regulating the speed of the engine. A clutch lever 23 is pivotally mounted on the handle and is connected to a conventional clutch (not shown) by a link 24. The clutch transmits power from the engine to the rear wheels for driving the apparatus. A trigger 25 is pivotally mounted on the handle for pulling a link 26 to open the spraying valve which will be described hereinafter.

The chassis includes a top wall 27 (FIG. 2), a pair of depending side walls 28, and a pair of transverse bracing walls 29. A front wall indicated at 30 in FIG. 1 but omitted for clarity in FIG. 2 and a rear wall 31 extends between the front and rear edges of the side walls. Axles **12*a* and 13*a* for the front and rear wheels, respectively, extend through the side walls 28**.

Figure 3:
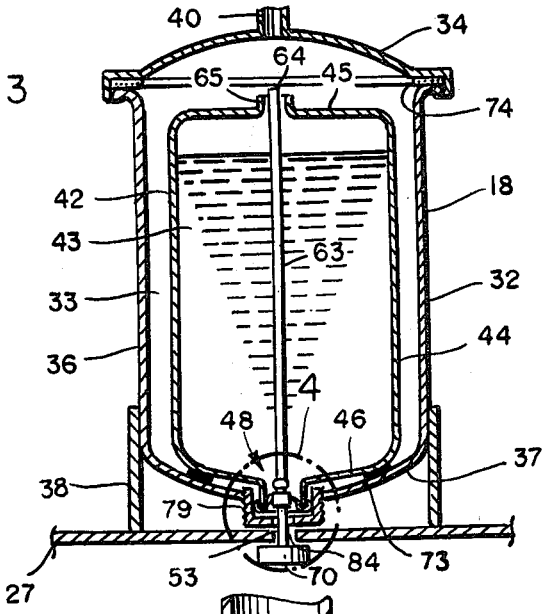
FIG. 3 is a fragmentary sectional view taken through the pressure chamber and the cartridge of the spraying apparatus.

The pressure vessel 18 comprises a casing which includes a main portion 32 which provides an internal pressure chamber 33 (FIG. 3) and a cover 34 which is removably clamped on the main portion by clamp 35. The casing includes a cylindrical side wall 36 and a dome-shaped bottom wall 37 and is supported by a collar 38 which is secured, as by welding or soldering, to the lower portion of the cylindrical side wall. The collar is connected to the top wall 27 of the chassis by angle brackets 39. The air hose 17 is connected to an inlet fitting 40 on the cover of the pressure vessel for supplying pressurized air to the pressure chamber. A bleed valve may be provided on the fitting for exhausting the pressure within the pressure vessel after the engine is turned off.

Figure 4:
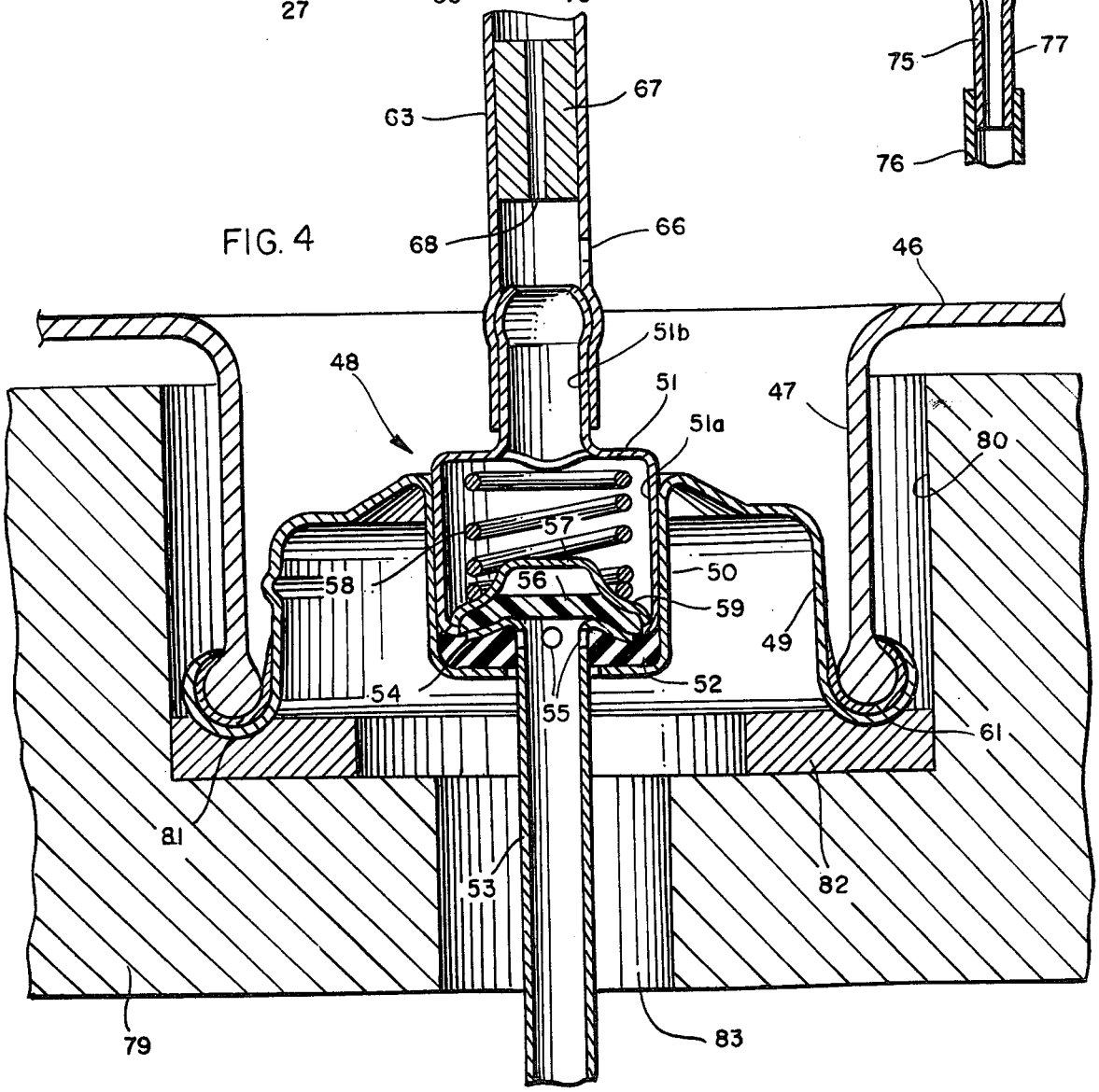
FIG. 4 is an enlarged fragmentary view of the bottom of FIG. 3.

A generally cylindrical cartridge 42 containing the material 43 to be sprayed is positioned within the pressure chamber and includes a cylindrical side wall 44, a top wall 45, and a bottom wall 46. Referring now to FIG. 4, the bottom wall 46 includes a downwardly extending collar 47 which defines a valve opening, and a valve assembly 48 is positioned within the opening and secured to the collar. The valve assembly can be a conventional valve of the type which is commonly employed in aerosol spray cans. The particular valve assembly illustrated in FIG. 4 includes a supporting frame 49 which provides a cup-shaped valve housing 50 and an inlet tube 51 which has a large diameter portion 51*a* secured to the inside surface of the valve housing and a reduced diameter portion 51*b*. An annular gasket 52 which acts as a valve seat is positioned at the bottom of the valve housing, and a valve stem 53 extends through the gasket and the valve housing. The upper end of the valve stem includes an outwardly and downwardly extending sealing flange 54 which engages the gasket 52, and one or more openings 55 are provided in the valve stem just below the sealing flange. A second gasket 56 is pressed against the upper end of the valve stem to seal the upper end by a sealing cup 57 which is forced downwardly by a spring 58. The sealing cup includes a shoulder 59 which presses the gasket 56 and sealing flange 54 downwardly to sealingly engage the gasket 52.

When the valve is in the position shown in FIG. 4, the valve is closed. The valve can be opened either by pushing the valve stem upwardly or by tilting the lower end of the valve stem laterally. When the stem is tilted, it rocks about a portion of the sealing flange 54 and raises one of the openings 55 above the gasket 52. The gasket 56 and sealing cup 57 are also tilted upwardly, and the contents of the cartridge can flow around the sealing cup 57 and through the openings 55 into the valve stem. The valve assembly is attached to the collar 47 of the cartridge by crimping the supporting frame 49 of the valve assembly about the beaded edge of the collar. Sealing material 61 is positioned between the collar and the crimped rim of the supporting frame to provide a hermetic seal.

A tube 63 is connected to the inlet tube 51 of the valve and extends upwardly to a point above the level of the contents of the cartridge. In the embodiment illustrated, the upper end 64 of the tube extends to an opening provided by an externally threaded collar 65 on the top wall of the cartridge. Both the cartridge and the upper end of the tube can therefore be hermetically sealed by screwing a gasket-equipped cap onto the collar. When the cartridge is sealed by the cap, the cartridge can be transported or stored without spilling the contents, exposing the contents to air, or allowing the contents to flow through the end 64 of the tube, even when the cartridge is inverted or is supported on its side. An orifice 66 is provided in the tube just above the valve assembly, and the bore of the tube is reduced just above the orifice by a plug 67 which has a bore 68 of smaller diameter than the bore of the tube.

Referring to FIG. 2, the valve stem extends through an opening in the top wall of the chassis, and a spraying nozzle 70 is positioned on the end of the valve stem. The particular spraying nozzle shown is similar to the spraying nozzle described in U.S. Pat. No. 3,817,429 and includes an elongated spraying orifice and a pair of flat aligning surfaces. An actuating bar 71 is slidably mounted on the top wall 27 of the chassis adjacent to the spraying nozzle in a manner similar similar to that described in U.S. Pat. Nos. 3,700,144 and 3,817,429, and the actuating bar is connected by a link to a bell crank 72 (FIG. 1) pivotally mounted at the rear of the chassis. When the trigger 25 is pulled upwardly, the link 26 rotates the bell crank, and the actuating bar moves forwardly to engage the spraying nozzle. Forward movement of the spraying nozzle tilts the valve stem and opens the valve.

When the spraying apparatus is to be used, the cover of the pressure vessel is removed and a cartridge containing the material to be sprayed, e.g., paint of a particular color, is placed inside the main portion of the pressure vessel. The cartridge is supported within the pressure vessel by an annular sealing gasket 73 (FIG. 3) which is attached to the bottom wall of the pressure vessel, and a gasket 74 provides a seal between the cover 34 and the main portion 32 of the pressure vessel when the cover is clamped in place. The opening in the collar 65 of the cartridge communicates the interior of the cartridge with the pressure chamber 33, and when the pressure vessel is pressurized by the air compressor, the pressure within the chamber 33, the tube 63, and the cartridge 44 are all equal.

The valve stem is at atmospheric pressure when the valve is closed. When the valve is open, pressurized air flows through the tube 63 and through the valve. The restrictor plug 67 restricts the flow of pressurized air through the tube from the upper end, and the air pressure within the tube below the restrictor is less than the air pressure within the pressure vessel. Since the pressure of the contents of the cartridge surrounding the orifice 66 in the tube is at the pressure of the pressure vessel, the contents of the cartridge will flow through the orifice, become entrained with the air flowing through the tube, and flow through the valve to the spraying nozzle. The spraying nozzle atomizes and sprays the contents downwardly toward the surface over which the spraying apparatus is being rolled.

Figure 5:
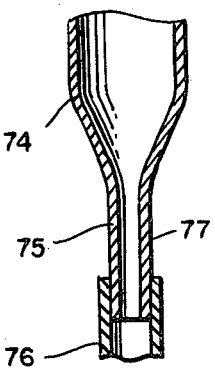
FIG. 5 is a fragmentary sectional view showing a different embodiment of pressure-reducing means.

In the embodiment illustrated in FIG. 4 the restrictor plug 67 functions as a means to reduce the pressure of the gas flowing through the tube when the valve is open. However, other pressure-reducing means can be used. FIG. 5 illustrates tube 74 having a Venturi section 75 for reducing the pressure of gas flowing through the tube to valve inlet tube 76. The orifice 77 is positioned within the Venturi section, and the contents of the cartridge are aspirated through the orifice into the tube.

In the embodiment illustrated in FIG. 4 the orifice 66 is provided in the tube 63 between the restrictor 67 and inlet tube 51 of the valve. However, the inlet tube 51 is an extension of the tube, and the orifice can also be provided in the inlet tube 51 or anywhere between the restrictor and the valve closure member.

An externally threaded adaptor plug 79 (FIGS. 3 and 4) is threaded into an opening of the bottom wall 37 of the pressure vessel, and the downwardly extending collar 47 of the cartridge to which the valve assembly is attached is positioned within a cylindrical recessed feed of the adaptor. The crimped or beaded edge 81 of the supporting frame of the valve assembly engages an annular gasket 82 supported within the adaptor plug, and the valve stem 53 extends through an opening 83 in the bottom of the adaptor plug and an opening 84 (FIG. 3) in the top wall 27 of the chassis. The cartridge is pressed downwardly against the sealing gasket 82 and 73 by the weight of the cartridge and by the pressure within the pressure vessel, and the cover of the pressure vessel is sealed by the gasket 74, thereby hermetically sealing the pressure vessel.

When the contents of the cartridge have been emptied or when it is desirable to change the material being sprayed, e.g., when paint of a different color is to be sprayed, all that need be done is to open the cover of the pressure vessel, remove the spraying nozzle 70 from the end of the valve stem 53, and lift the cartridge 44 out of the pressure vessel. The new cartridge is then inserted into the pressure vessel so that the bottom wall 46 and beaded edge 81 sealingly engage the gaskets 73 and 82, respectively, the cover is closed, and a new spraying nozzle 70 is positioned on the valve stem 53. The replacement of the cartridge takes only a matter of seconds.

The contents of the cartridge never contact the pressure vessel but are confined entirely within the cartridge, and it is not necessary to clean the pressure vessel either when the cartridge is replaced or when the spraying operation has been completed. Further, the spraying apparatus does not use hoses, complicated nozzles, and the like which also generally require cleaning. The spraying nozzle 70 can be an inexpensive molded plastic nozzle, which can be discarded after each use.

Since the cartridge is not required to withstand pressure, the pressure both inside and outside of the cartridge being equal to the pressure within the pressure vessel, the cartridge can be made inexpensively, e.g., from molded plastic. Accordingly, the cartridge can economically be discarded when it is empty. Alternatively, the cartridge can be refilled by pouring additional contents through the mouth provided by the threaded collar 65. A partially empty cartridge can be resealed and stored for later use by screwing an internally threaded cap over the end of the collar 65 to close the opening of the collar and to seal upper end 64 of the tube.

If desired, the spraying apparatus can be provided with means for varying the width of the stripe which is sprayed by the nozzle 70. For example, the height of the nozzle, i.e., the distance between the nozzle and the surface to be sprayed, can be adjustable, or the orientation of the elongated spraying orifice relative to the direction in which the apparatus is advanced could be adjusted as described in U.S. Pat. No. 3,924,784.

A spraying apparatus formed in accordance with the invention is able to operate effectively at relatively low pressure. For example, when the apparatus is used to spray paint having a viscosity within the normal industry accepted viscosity range, the apparatus can operate at a pressure below 100 psi. By normal industry accepted viscosity range I mean paint having a viscosity within the range of 17 to 32 seconds as measured by the Zahn Cup method at a temperature of 80° F. The relative sizes of the internal diameter of the air tube 63 and the diameter of the paint inlet orifice 66 can be such that the ratio of these diameters falls within the range of 40 to 1 to 1 to 1.

Although I have described the source of pressurized gas as a motor-driven air compressor, it will be understood that other supply means can be used, e.g., cylinders of compressed air, or other gases.

While in the foregoing specification a detailed description of specific embodiments have been given for the purpose of illustration, it is to be understood that many of the details herein given may be varied considerably by those skilled in the art without departing from the spirit and scope of the invention.

I claim:

1. A spraying apparatus comprising a casing providing an internal chamber adapted to be supplied with pressurized gas, a cartridge within the casing, the cartridge containing contents to be sprayed and having an upper end and a lower end, the upper end of the cartridge above the contents thereof communicating with the chamber so that the pressure of the contents of the cartridge and the pressure within the chamber are substantially equal, a tube within the cartridge extending into the contents of the cartridge and having an end communicating with the chamber, a valve attached to the tube and communicating with the outside of the chamber, the tube being provided with an opening below the level of the contents of the cartridge and between the valve and said end of the tube, and pressure-reducing means between the opening and said end of the tube for reducing the pressure of gas flowing through the tube whereby when the valve is open the pressure within the tube adjacent to the opening is less than the pressure of the contents of the cartridge and the contents flow through the opening and mix with gas flowing through the tube and the mixed contents and gas flow through the valve to the outside of the chamber.

2. The apparatus of claim 1 including a valve stem extending from the valve to the outside of the chamber and a spraying nozzle mounted on the valve stem for spraying the contents of the cartridge which flow through the valve when the valve is open.

3. The apparatus of claim 1 in which the diameter of the bore of the tube through which the pressurized gas flows is reduced upstream of the opening into the tube to provide the pressure-reducing means.

4. The apparatus of claim 1 in which the pressure-reducing means is a plug within the tube having a bore smaller than the bore of the tube.

5. The apparatus of claim 1 in which the tube includes a Venturi section which provides the pressure-reducing means, the opening being located in the Venturi section.

6. The apparatus of claim 1 in which the cartridge is removably mounted within the casing whereby the cartridge can be replaced when the contents thereof have been emptied.

7. The apparatus of claim 1 in which the valve is attached to the lower end of the cartridge and the casing is provided with an opening adjacent to the valve, and a gasket surrounding the valve and the opening in the casing between the lower end of the cartridge and the casing for preventing pressurized gas from passing through the opening in the casing.

8. The apparatus of claim 1 in which the spraying apparatus includes a wheel-equipped frame and means mounted on the frame for supplying pressurized gas to the chamber of the casing.

9. The apparatus of claim 8 including a valve stem extending from the valve to the outside of the chamber, a spraying nozzle mounted on the valve stem for spraying the contents of the cartridge which flow through the valve when the valve is open, and means on the frame for moving the valve stem for opening the valve.

10. A cartridge for use with a spraying apparatus having a casing providing a pressure chamber, the cartridge containing contents to be sprayed, a valve mounted on the cartridge for conveying the contents out of the cartridge when the valve is open, a tube in the cartridge extending from the valve and terminating in an end which is positioned above the level of the contents when the cartridge is positioned so that the valve is at the bottom thereof, the tube being provided with an opening between the valve and said end of the tube and pressure-reducing means in the tube between the opening and said end of the tube for reducing the pressure of gas flowing through the tube, and means on the cartridge for communicating the upper end of the cartridge with the outside of the cartridge when the cartridge is positioned so that the valve is at the bottom of the cartridge whereby the pressure on the contents is the same as the pressure in the pressure chamber.

11. The cartridge of claim 10 in which the means for communicating the upper end of the cartridge with the outside of the cartridge is an opening in the cartridge.

12. The cartridge of claim 10 in which the diameter of the bore of the tube through which the pressurized gas flows is reduced upstream of the opening into the tube to provide the pressure-reducing means.

13. The cartridge of claim 10 in which the pressure-reducing means is a plug within the tube having a bore smaller than the bore of the tube.

14. The cartridge of claim 10 in which the tube includes a Venturi section which provides the pressure-reducing means, the opening being located in the Venturi section.

* * * * *